US009265340B2

(12) United States Patent
Krusin et al.

(10) Patent No.: US 9,265,340 B2
(45) Date of Patent: Feb. 23, 2016

(54) ARTICLE OF FURNITURE AND METHOD OF STACKING THE SAME

(71) Applicant: Knoll, Inc., East Greenville, PA (US)

(72) Inventors: Marc Krusin, London (GB); Pavel Ruzicka, Pennsburg, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 14/522,047

(22) Filed: Oct. 23, 2014

(65) Prior Publication Data

US 2015/0118010 A1 Apr. 30, 2015

Related U.S. Application Data

(60) Provisional application No. 61/896,248, filed on Oct. 28, 2013.

(51) Int. Cl.

| | |
|---|---|
| ***A47B 3/00*** | (2006.01) |
| ***A47B 3/08*** | (2006.01) |
| ***A47B 13/00*** | (2006.01) |
| ***A47C 4/04*** | (2006.01) |
| ***A47B 7/02*** | (2006.01) |

(52) U.S. Cl.

CPC ..... *A47B 3/0803* (2013.01); *A47B 3/0815* (2013.01); *A47B 7/02* (2013.01); *A47B 13/003* (2013.01); *A47C 4/04* (2013.01); *A47B 2003/0806* (2013.01); *A47B 2200/0029* (2013.01)

(58) Field of Classification Search

CPC .. A47B 7/02; A47B 87/02; A47B 2003/0806; A47B 3/00; A47C 1/124; A47C 3/04

USPC ..... 108/115, 91, 127, 136, 2, 7, 9, 10; 248/188.6, 370, 371

See application file for complete search history.

(56) References Cited

U.S. PATENT DOCUMENTS

| | | | |
|---|---|---|---|
| 1,240,390 | A | 9/1917 | Uhl |
| 2,796,307 | A | 7/1957 | Knoll |

(Continued)

FOREIGN PATENT DOCUMENTS

| | | | |
|---|---|---|---|
| EP | 1308109 | A1 | 5/2003 |
| EP | 1836926 | A1 | 9/2007 |

(Continued)

OTHER PUBLICATIONS

International Search Report for PCT/US2014/062137 dated Nov. 27, 2014.

(Continued)

*Primary Examiner* — Janet M Wilkens

(74) *Attorney, Agent, or Firm* — Buchanan Ingersoll & Rooney PC

(57) ABSTRACT

An article of furniture includes a structure having a surface that supports a weight. The surface may be tiltable from a first position in which the surface is flat or substantially horizontal and a second position in which the surface is substantially vertical. At least one leg rotating mechanism may attach at least one leg of the article of furniture to the surface so that the at least one leg is rotatable about a vertical axis when the surface is tilted. In some embodiments, the article may be a table and the surface may be a tabletop. In other embodiments, the article may be a chair and the surface may be a seating surface of a seat.

22 Claims, 13 Drawing Sheets

(56) References Cited

U.S. PATENT DOCUMENTS

| | | | | |
|---|---|---|---|---|
| 2,903,312 | A | 9/1959 | Lawless | |
| 3,166,029 | A | 1/1965 | Acton | |
| 3,382,820 | A | 5/1968 | Cafiero et al. | |
| 3,408,965 | A | 11/1968 | Hamilton et al. | |
| 5,931,488 | A * | 8/1999 | Graziano | A47B 13/00 108/127 |
| 6,389,988 | B1 | 5/2002 | Frattini | |
| 6,550,402 | B1 | 4/2003 | Stone et al. | |
| 6,637,352 | B1 * | 10/2003 | Thode | A47B 3/08 108/115 |
| 7,066,098 | B2 | 6/2006 | Blasen et al. | |
| 7,703,400 | B2 * | 4/2010 | Mockel | A47B 3/0803 108/115 |
| 7,765,938 | B2 | 8/2010 | Piretti | |
| 7,845,290 | B2 | 12/2010 | Piretti | |
| 8,091,488 | B2 | 1/2012 | Chirea et al. | |
| 8,291,830 | B2 * | 10/2012 | Rutz | A47B 3/0818 108/115 |
| 8,342,462 | B2 | 1/2013 | Sapper et al. | |
| 8,347,796 | B2 | 1/2013 | Udagawa et al. | |
| D686,856 | S | 7/2013 | Krusin | |
| 8,505,186 | B2 | 8/2013 | van Hekken et al. | |
| 2005/0252426 | A1 * | 11/2005 | Blasen | A47B 7/02 108/91 |
| 2006/0230991 | A1 * | 10/2006 | Piretti | A47B 3/0803 108/115 |
| 2007/0209559 | A1 | 9/2007 | Mockel | |
| 2010/0044541 | A1 | 2/2010 | Sapper et al. | |
| 2011/0304183 | A1 | 12/2011 | van Hekken | |
| 2012/0304902 | A1 | 12/2012 | Ruzicka | |
| 2012/0306240 | A1 | 12/2012 | van Hekken | |
| 2013/0118387 | A1 | 5/2013 | Peery et al. | |

FOREIGN PATENT DOCUMENTS

| | | | |
|---|---|---|---|
| EP | 1958537 | A1 | 8/2008 |
| JP | 11018840 | * | 1/1999 |

OTHER PUBLICATIONS

Written Opinion of the International Searching Authority dated Nov. 27, 2014.

Written Opinion for the International Searching Authority for PCT/US2014/062137 dated Nov. 27, 2014.

* cited by examiner

ARTICLE OF FURNITURE AND METHOD OF STACKING THE SAME

CROSS-REFERENCE TO RELATED APPLICATIONS

The present application claims priority to U.S. Provisional Patent Application No. 61/896,248, which was filed on Oct. 28, 2013.

FIELD OF THE INVENTION

The present invention relates to articles of furniture such as tables or chairs and methods of making and using articles of furniture.

BACKGROUND OF THE INVENTION

Tables and other articles of furniture are often configured to have a number of legs that support a surface. For instance, tables may have legs or a stand that supports a tabletop. As another example, a chair may have a pedestal base or legs that support a seat. Examples of such articles of furniture may be appreciated from U.S. Pat. Nos. D686,856, 1,240,390, 2,796,307, 2,903,312, 3,166,029, 3,382,820, 3,408,965, 6,389,988, 6,550,402, 7,066,098, 7,765,938, 7,845,290, 8,091,488, 8,342,462, 8,347,796, 8,505,186, and U.S. Pat. App. Pub. Nos. 2010/0044541, 2011/0304183, 2012/0304902, 2012/0306240, and 2013/0118387.

Tables, chairs and other furniture may be nested, or stacked when stored to preserve space. For instance, chairs may be configured to be stacked on top of each other. As another example, tables may be configured to be stacked on top of each other or nested beside other tables.

We have determined that a new arrangement for an article of furniture is needed to improve the ability of furniture to be easily nested, or stacked.

SUMMARY OF THE INVENTION

An article of furniture is provided. The article of furniture may include a first structure having a first surface and a second surface opposite the first surface where the first and second surfaces extend from a first edge of the first structure to a second edge of the first structure that is opposite the first edge of the first structure. The article may also include a first tilting mechanism attached to the first structure that is sized and configured such that the first structure is rotatable from a first position to a second position. The first edge of the first structure may be at a first elevation when the first structure is in the first position and the first edge of the first structure may be at a second elevation that is higher than the first elevation when the first structure is in the second position. A first leg may also be included in the article. The first leg can be movable from a first position to a second position. A first leg rotating mechanism may be attached between the first leg and the first tilting mechanism. The first leg rotating mechanism may rotate the first leg from the first position of the first leg to the second position of the first leg when the first structure is rotated from the first position of the first structure to the second position of the first structure.

In some embodiments, the article of furniture may be a table such as a work table, a dining table, an end table, a side table, or a moveable table that may have a tabletop that is useable for numerous different activities such as work related activities, eating, or other activities. In other embodiments, it is contemplated that the article of furniture may be a chair.

In some embodiments, the article of furniture may be configured as a table and the first structure may be a tabletop and the first surface may be a flat surface or is a substantially flat surface and the second surface may be a flat surface or a substantially flat surface. A substantially flat surface may be a surface that has a slight inclination or declination (e.g. between 1-3 degree of declination or inclination) or a slight variance between intermediate portions of the surface.

The article of furniture may also include a second leg that is movable from a first position to a second position and a second tilting mechanism attached to the first structure. The second tilting mechanism may be sized and configured such that the first structure is rotatable from the first position to the second position. The second leg rotating mechanism may be attached between the second leg and the second tilting mechanism. The second leg rotating mechanism can rotate the second leg from the first position of the second leg to the second position of the second leg when the first structure is rotated from the first position of the first structure to the second position of the first structure. The article may also include at least one first foot connected to the first leg and at least one second foot connected to the second leg.

In some embodiments of the article of furniture, the first tilting mechanism may comprise a first carriage positioned between the first leg and the first tilting mechanism. The first carriage can be connected to the first structure such that the first structure is rotatable about a horizontal axis from the first position of the first structure to the second position of the first structure. The first leg rotating mechanism may comprise a first member, a first arm, and a first leg connecting body connecting the first leg rotating mechanism to the first leg. The first member may have a first end connected to a portion of the first tilting mechanism and a second end attached to the first arm. The first end of the first member can be connected to the first tilting mechanism such that the first member moves when the first structure is moved from the first position of the first structure to the second position of the first structure. The movement of the first member can cause the first arm to move to drive rotation of the first leg connecting body so that the first leg is rotated and the at least one first foot is rotated from a first position to a second position. The second tilting mechanism may include a second carriage positioned between the second leg and the second tilting mechanism. The second carriage may be connected to the first structure such that the first structure is rotatable about the horizontal axis from the first position of the first structure to the second position of the first structure. The second leg rotating mechanism may comprise a second member, a second arm, and a second leg connecting body connecting the second leg rotating mechanism to the second leg. The second member may have a first end connected to a portion of the second tilting mechanism and a second end attached to the second arm. The first end of the second member can be connected to the second tilting mechanism such that the second member moves when the first structure is moved from the first position of the first structure to the second position of the first structure. The movement of the second member can cause the second arm to move to drive rotation of the second leg connecting body so that the second leg is rotated and the at least one second foot is rotated from a first position to a second position.

The first member of the first leg rotating mechanism may have a number of configurations. For instance, the first member may be a generally L-shaped member, a generally C-shaped member, a generally U-shaped member or a generally V-shaped member. The second member of the second leg rotating mechanism may also have a number of different configurations. For example, the second member may be a generally L-shaped member, a generally C-shaped member, a generally U-shaped member or a generally V-shaped member.

In some embodiments, the first tilting mechanism may be comprised of a first connector member and a first shaft connected to the first connector member. The first shaft may also be connected to the first carriage such that the first connector member is rotatable about the first shaft. The second tilting mechanism may be comprised of a second connector member and a second shaft connected to the second connector member. The second shaft can also be connected to the second carriage such that the second connector member is rotatable about the second shaft. The first connector member may be attached to the first surface of the first structure and the second connector member may be attached to the first surface of the first structure. The first and second connector members may connect the first structure to the first and second tilting mechanisms to permit the first structure to be rotated from the first position of the first structure to the second position of the first structure. The first and second shafts can define an axis about which the first structure is rotatable. In some embodiments, the first member of the first leg rotating mechanism can extend from adjacent the first connector member to adjacent the first arm and the second member of the second leg rotating mechanism may extend from adjacent the second connector member to adjacent the second arm.

A cross member may extend between the first leg and the second leg in some embodiments of the article of furniture. The first arm may be positioned within a first end of the cross member and the second arm may be positioned within a second end of the cross member that is opposite the first end of the cross member. The first carriage can be attached to the cross member such that the first arm is below the first carriage and the second carriage may be attached to the cross member such that the second arm is below the second carriage.

In some embodiments of the article of furniture, the first leg rotating mechanism can also be comprised of a first pin attached to a distal end of the first arm and a first element extending from the first pin to the second end of the first member and the second leg rotating mechanism is also comprised of a second pin attached to a distal end of the second arm and a second element extending from the second pin to the second end of the second member. For example, the first pin can be rotatably connected to the distal end of the first arm and the second pin may be rotatably connected to the distal end of the second arm. As another example, the first element can be slideably connected to the first pin and to the second end of the first member and the second element can be slideably connected to the second pin and the second end of the second member.

The first and second leg rotating mechanisms may also be configured to include other elements in some embodiments of the article of furniture. For example, the first leg rotating mechanism may also be comprised of a first axle extending through a portion of the first arm. The first arm may be rotatable about the first axle such that movement of the distal end of the first arm causes rotation of the first arm about the first axle and drives rotation of the first leg connecting body. The second leg rotating mechanism may also be comprised of a second axle extending through a portion of the second arm. The second arm can be rotatable about the second axle such that the movement of the distal end of the second arm causes rotation of the second arm about the second axle and drives rotation of the second leg connecting body.

It should be appreciated that the at least one first foot can be comprised of only one foot or of multiple feet. For instance, the at least one first foot may include a first front foot and a first rear foot and the at least one second foot may include a second rear foot and a second front foot. The first front foot may be in the second position of the first front foot and the second front foot can be in the second position of the second front foot and the first and second front feet may be farther apart as compared to when the first front foot is in the first position of the first front foot and the second front foot is in the first position of the second front foot. When the first rear foot is in the second position of the first rear foot and the second rear foot is in the second position of the second rear foot, the first and second rear feet may be closer together as compared to when the first rear foot is in the first position of the first rear foot and the second rear foot is in the first position of the second rear foot. The first front foot may be a caster, the second front foot may be a caster, the third front foot may be a caster and the fourth front foot may be a caster. Alternatively, the first, second, third and fourth feet may each be a non-moving stud or ground contacting structure that is not rollable along a floor.

An article of furniture is also provided that includes a tabletop having a first surface and a second surface opposite the first surface. The first and second surfaces extend from a first edge of the tabletop to a second edge of the tabletop that is opposite the first edge of the tabletop. A first tilting mechanism is attached to the tabletop. The first tilting mechanism is sized and configured such that the first tabletop is rotatable from a first position to a second position. The first edge of the tabletop is at a first elevation when the tabletop is in the first position and the second edge of the tabletop is at a second elevation when the tabletop is in the second position. The second elevation is higher than the first elevation. A first leg can be attached to the first tilting mechanism via a first leg rotating mechanism attached between the first leg and the first titling mechanism. The first leg rotating mechanism can be attached between the first leg and the first tilting mechanism such that the first leg is moveable from a first position to a second position when the tabletop is moved from the first position of the tabletop to the second position of the tabletop. A second leg is movable from a first position to a second position. A second tilting mechanism is attached to the tabletop. The second tilting mechanism is sized and configured such that the tabletop is rotatable from the first position to the second position. A second leg rotating mechanism is attached between the second leg and the second tilting mechanism. The second leg rotating mechanism is configured to rotate the second leg from the first position of the second leg to the second position of the second leg when the tabletop is rotated from the first position of the first structure to the second position of the first structure.

The first tilting mechanism can include a first carriage positioned between the first leg and the first tilting mechanism, a first connector member attached to the first surface of the tabletop and rotatably connected to the first carriage, and a first shaft attached to the first connector member. The second tilting mechanism can include a second carriage positioned between the second leg and the second tilting mechanism, a second connector member attached to the first surface of the tabletop and rotatably connected to the second carriage, and a second shaft attached to the second connector member. The first leg rotating mechanism can include a first member having a first end connected to the first shaft and a second end opposite the first end of the first member, a first arm, a first pin rotatably attached to a distal end of the first arm, a first element extending from the first pin to within the second end of the first member such that the first element is moveably positionable within the second end of the first member, and a first leg connecting body connecting the first arm to the first leg, and a first axle extending through a portion of the first arm. The first arm can be rotatable about the first axle such that movement of the distal end of the first arm causes rotation of the first arm about the first axle and causes movement of the first leg connecting body to rotate the first leg from the first position of the first leg to the second position of the first leg. The second leg rotating mechanism can include a second member having a first end connected to the second shaft and a second end opposite the first end of the second member, a second arm, a second pin rotatably attached to a distal end of the second arm, a second element extending from the second pin to within the second end of the second member such that the second element is moveably positionable within the second end of the second member, and a second leg connecting body connecting the second arm to the second leg, and a second axle extending through a portion of the second arm. The second arm can be rotatable about the second axle such that movement of the distal end of the second arm causes rotation of the second arm about the second axle and causes rotation of the second leg connecting body to rotate the second leg from the first position of the second leg to the second position of the second leg. The first and second shafts can define an axis about which the tabletop is rotatable when the tabletop moves from the first position to the second position. The first end of the first member of the first leg rotation mechanism can rotate during movement of the tabletop from the first position of the tabletop to the second position of the tabletop such that rotation of the first end of the first member causes the first element to move within the second end of the first member and causes the first pin to rotate relating to the distal end of the first arm and also causes the first pin to move to drive rotation of the first arm about the first axle such that the first leg connecting body moves to rotate the first leg from the first position of the first leg to the second position of the first leg. The first end of the second member of the second leg rotation mechanism can rotate during movement of the tabletop from the first position of the tabletop to the second position of the tabletop. Rotation of the first end of the second member can cause the second element to move within the second end of the second member and cause the second pin to rotate relating to the distal end of the second arm and also cause the second pin to move to drive rotation of the second arm about the second axle such that the second leg connecting body moves to rotate the second leg from the first position of the second leg to the second position of the second leg.

A cross member may extend between the first leg and the second leg. The first arm can be positioned within a first end of the cross member and the second arm can be positioned within a second end of the cross member that is opposite the first end of the cross member. The first carriage can be attached to the cross member such that the first arm is below the first carriage and the second carriage can be attached to the cross member such that the second arm is below the second carriage.

Embodiments of the article of furniture can include a first front foot and a first rear foot connected to the first leg and a second front foot and a second rear foot connected to the second leg. The first front foot and the second front foot can be moved away from each other when the first and second legs are moved from their first positions to their second positions. The first rear foot and the second rear foot can be moved to be closer to each other when the first and second legs are moved from their first positions to their second positions.

In some embodiments, the first member of the first leg rotating mechanism also has an intermediate member extending between the first and second ends of the first member of the first leg rotating mechanism such that the first member is a generally L-shaped member, a generally C-shaped member, a generally U-shaped member or a generally V-shaped member. The second member of the second leg rotating mechanism can have an intermediate member extending between the first and second ends of the second member of the second leg rotating mechanism such that the second member is a is a generally L-shaped member, a generally C-shaped member, a generally U-shaped member or a generally V-shaped member.

In some embodiments, the first element is a rod, a pin, a linearly extending member, or a shaft and the second element is a rod, a pin, a linearly extending member, or a shaft. Additionally, the first shaft can be a rod or other type of linearly extending member and the second shaft can be a rod or other type of linearly extending member.

A method of stacking tables is also provided. The method may include providing a plurality of tables. Each of the tables may be an article of furniture as mentioned above or discussed more fully herein. The method may also include the step of moving the first structure of each of the tables from the first position to the second position so that the first leg is also moved from the first position of the first leg to the second position of the first leg. The tables may then be nested adjacent to each other to stack the tables.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of an article of furniture are shown in the accompanying drawings and certain exemplary methods of practicing the same are also illustrated therein. It should be appreciated that like reference numbers used in the drawings may identify like components.

DETAILED DESCRIPTION OF EXEMPLARY EMBODIMENTS

Figure 1:
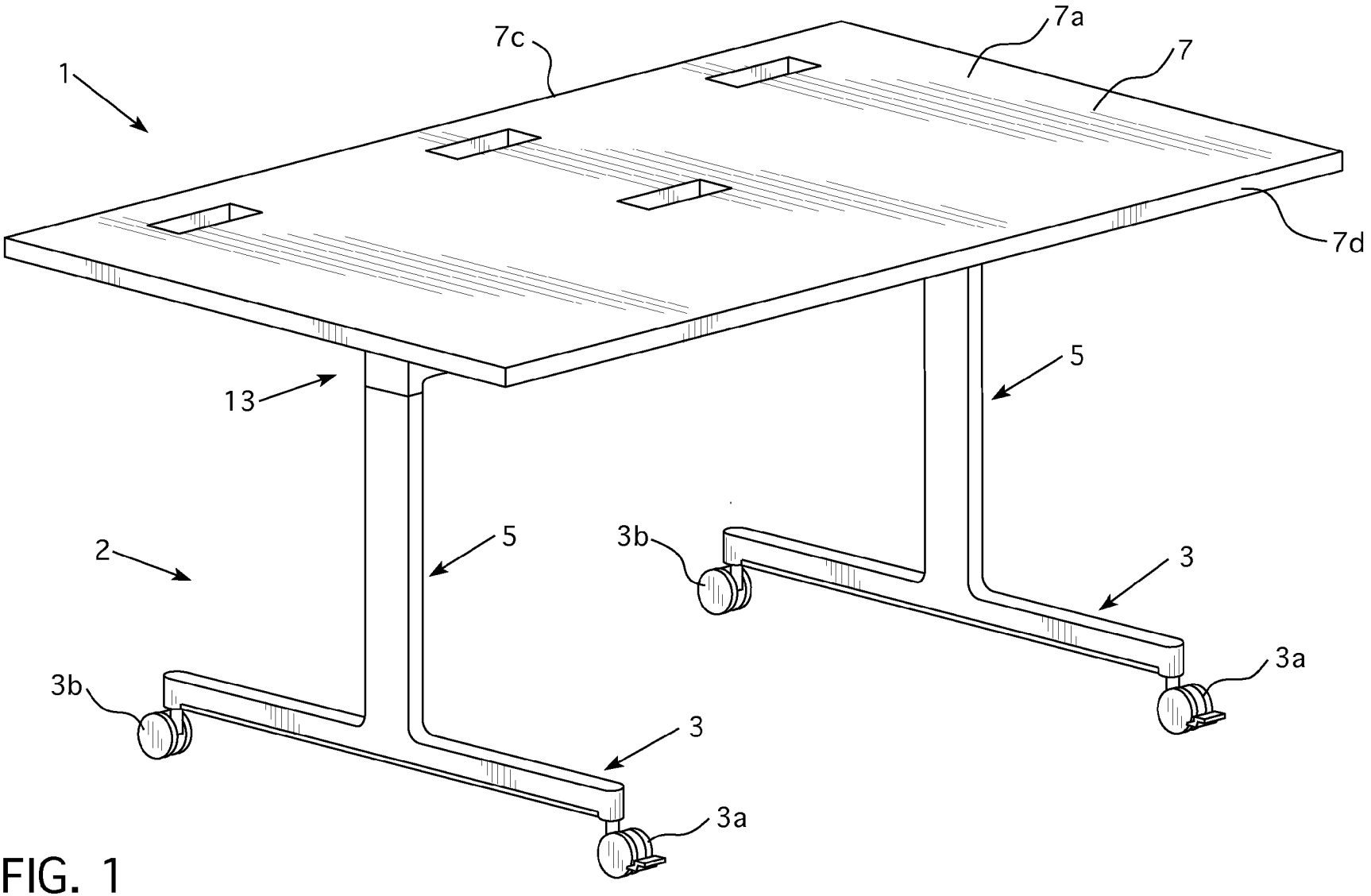
FIG. 1 is a perspective view of a first exemplary embodiment of an article of furniture, in a first position in a surface of the tabletop is substantially flat or substantially horizontal and legs of the article are in a first position.
Figure 2:
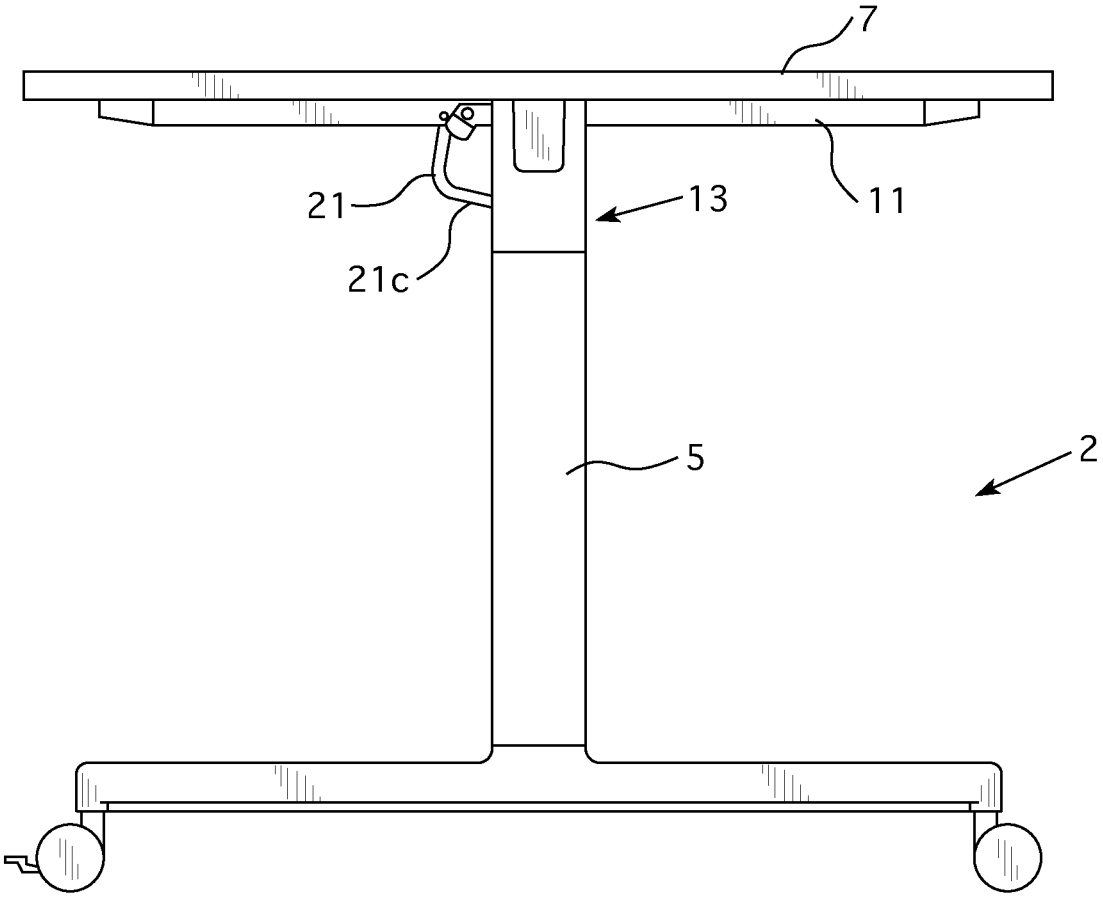
FIG. 2 is a side view of the first exemplary embodiment of the article of furniture in the first position.
Figure 3:
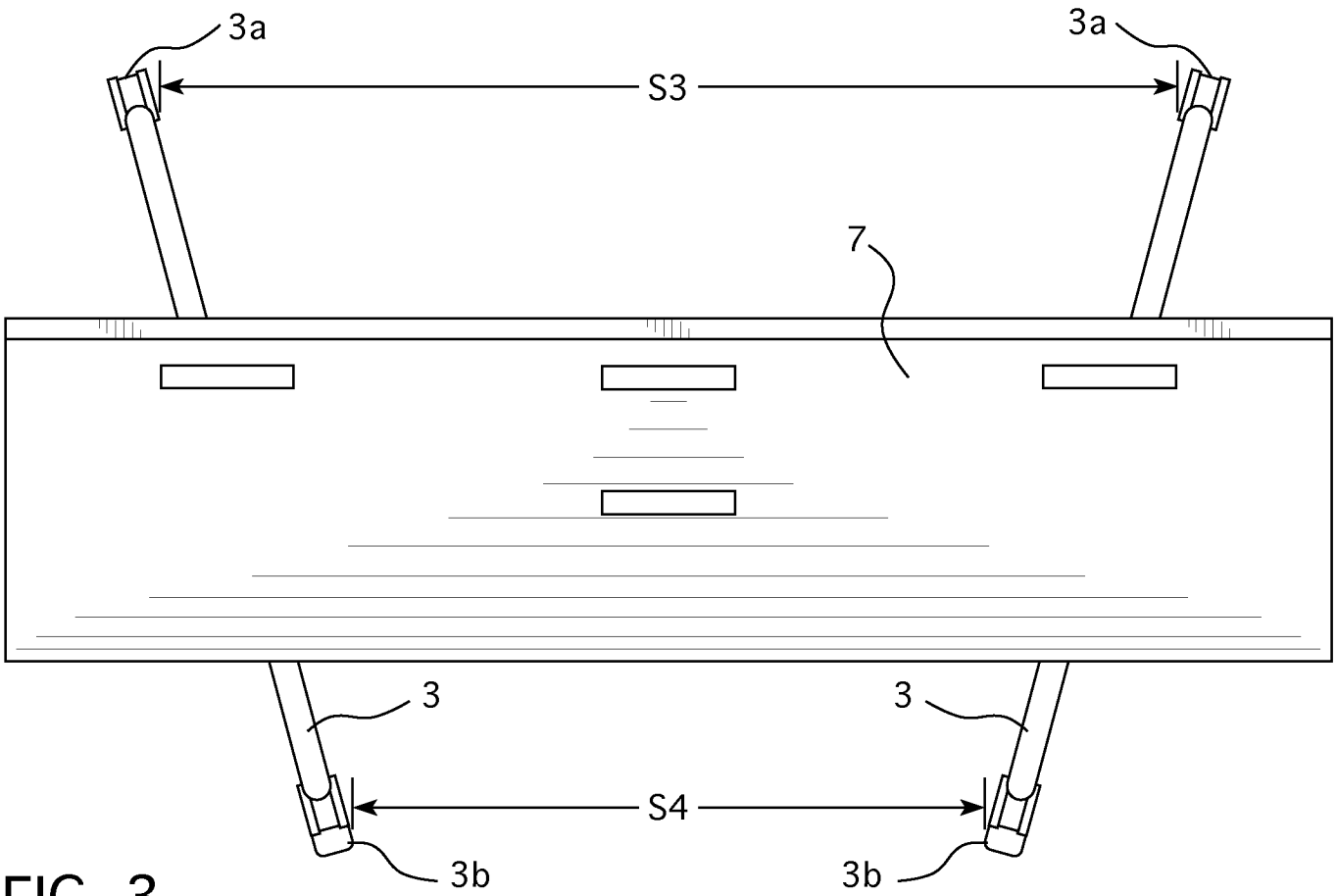
FIG. 3 is a top view of the first exemplary embodiment of the article of furniture in a second position in which the tabletop is tilted to be substantially vertical and the legs of the article are in a second position so that front feet are farther apart from each other as compared to the space between the rear feet.
Figure 4:
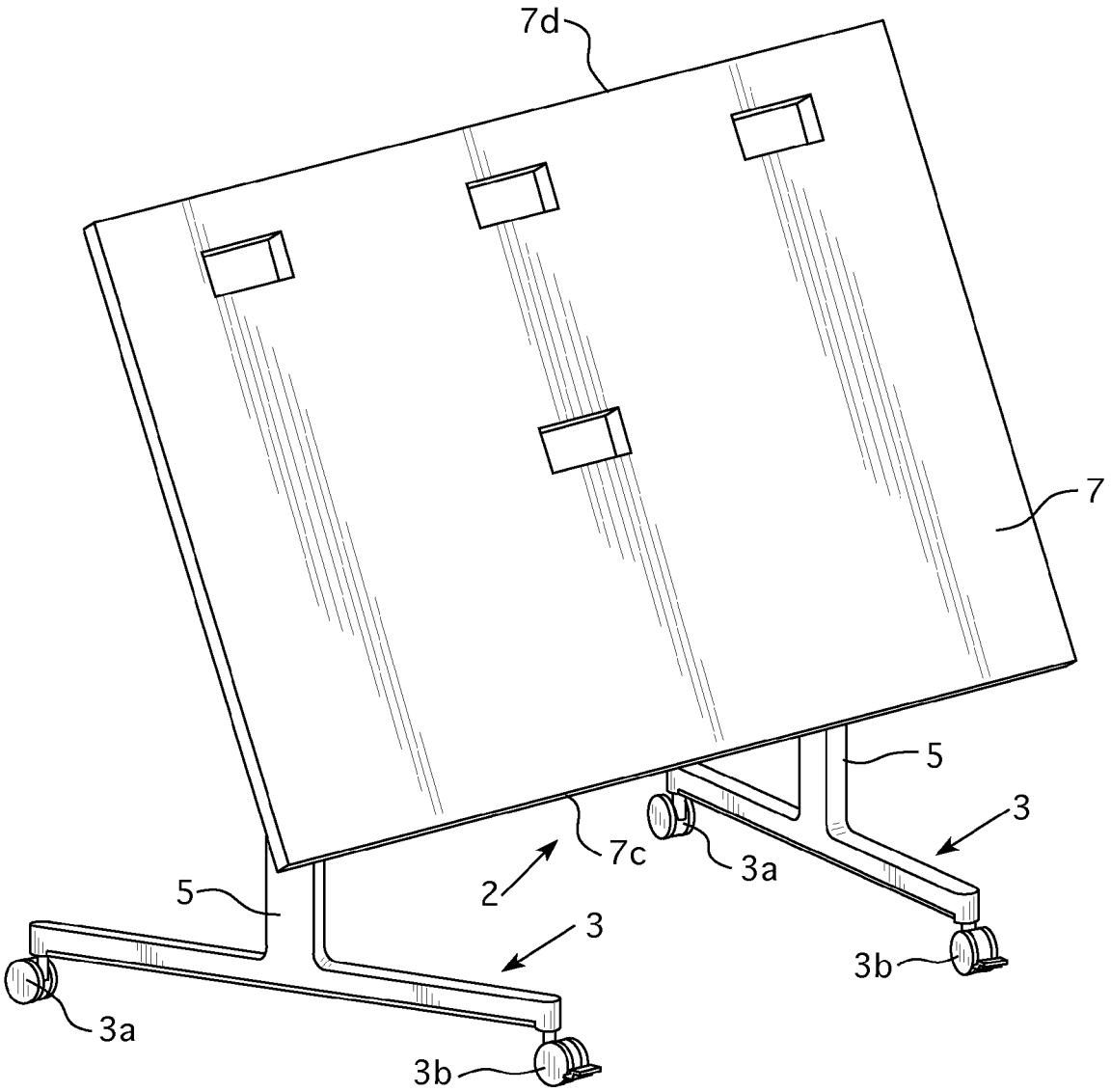
FIG. 4 is a perspective view of the first exemplary embodiment of the article of furniture in the second position.
Figure 5:
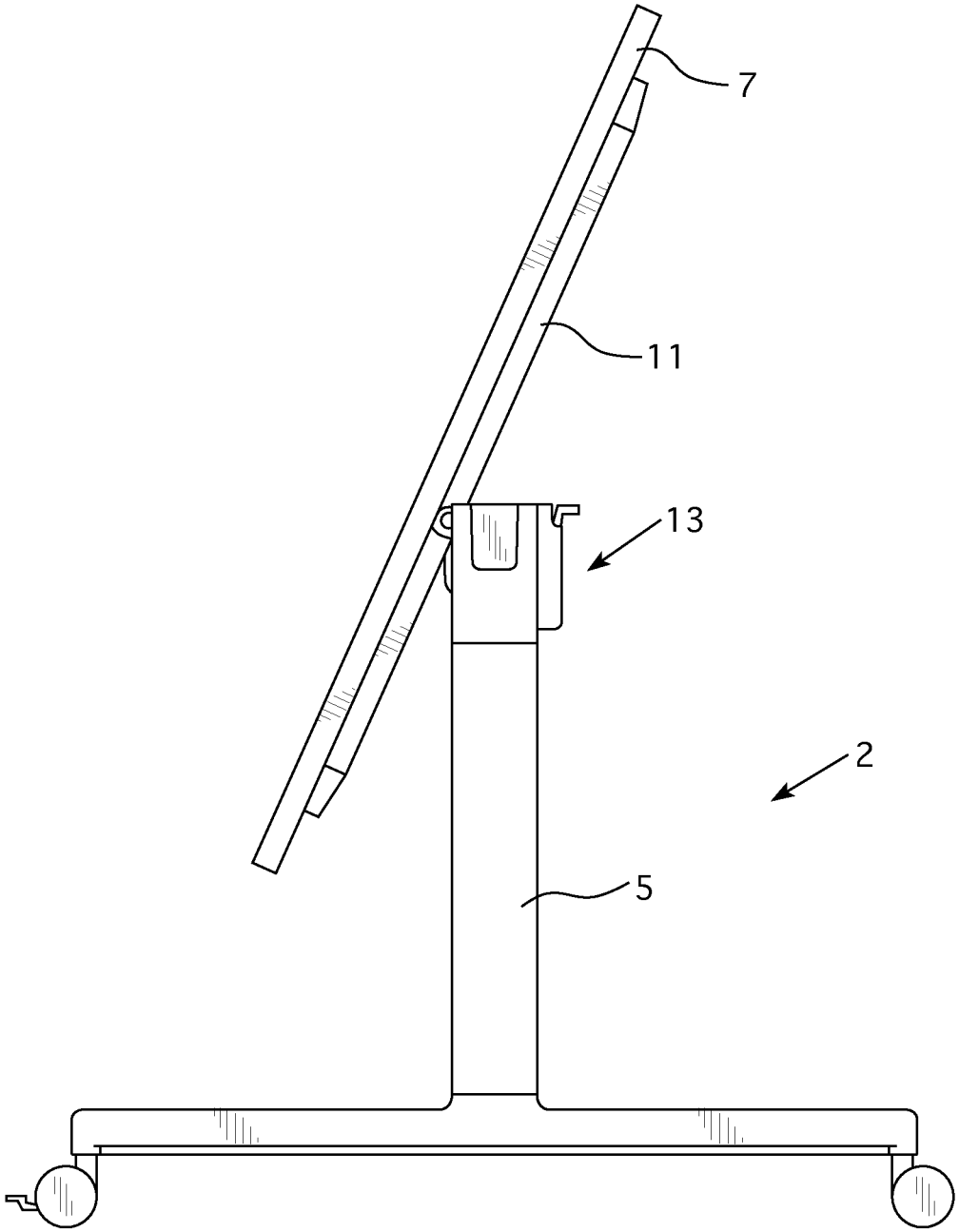
FIG. 5 is a side view of the first exemplary embodiment of the article of furniture in the second position.
Figure 6:
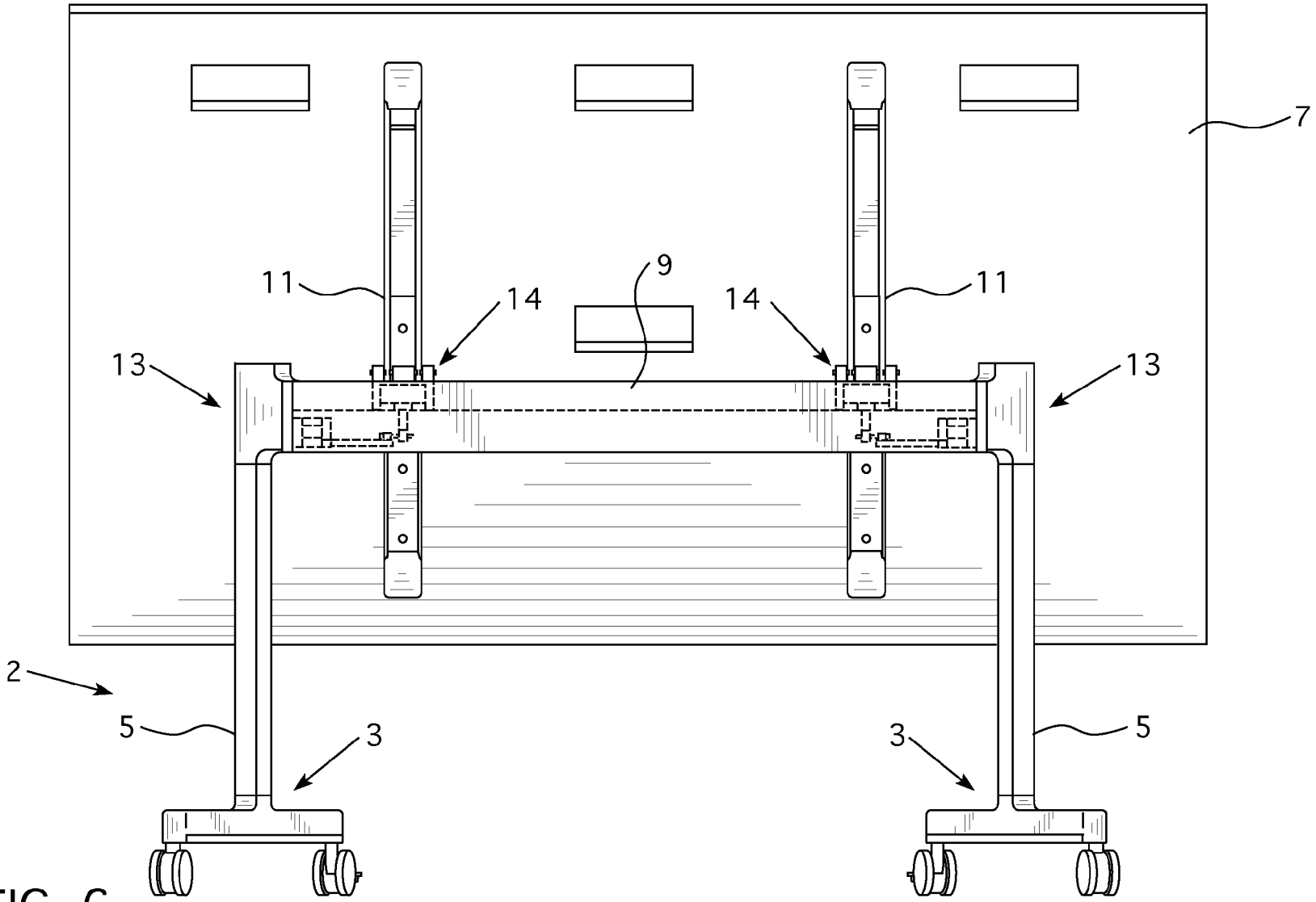
FIG. 6 is a rear view of the first exemplary embodiment of the article of furniture in the second position.
Figure 7:
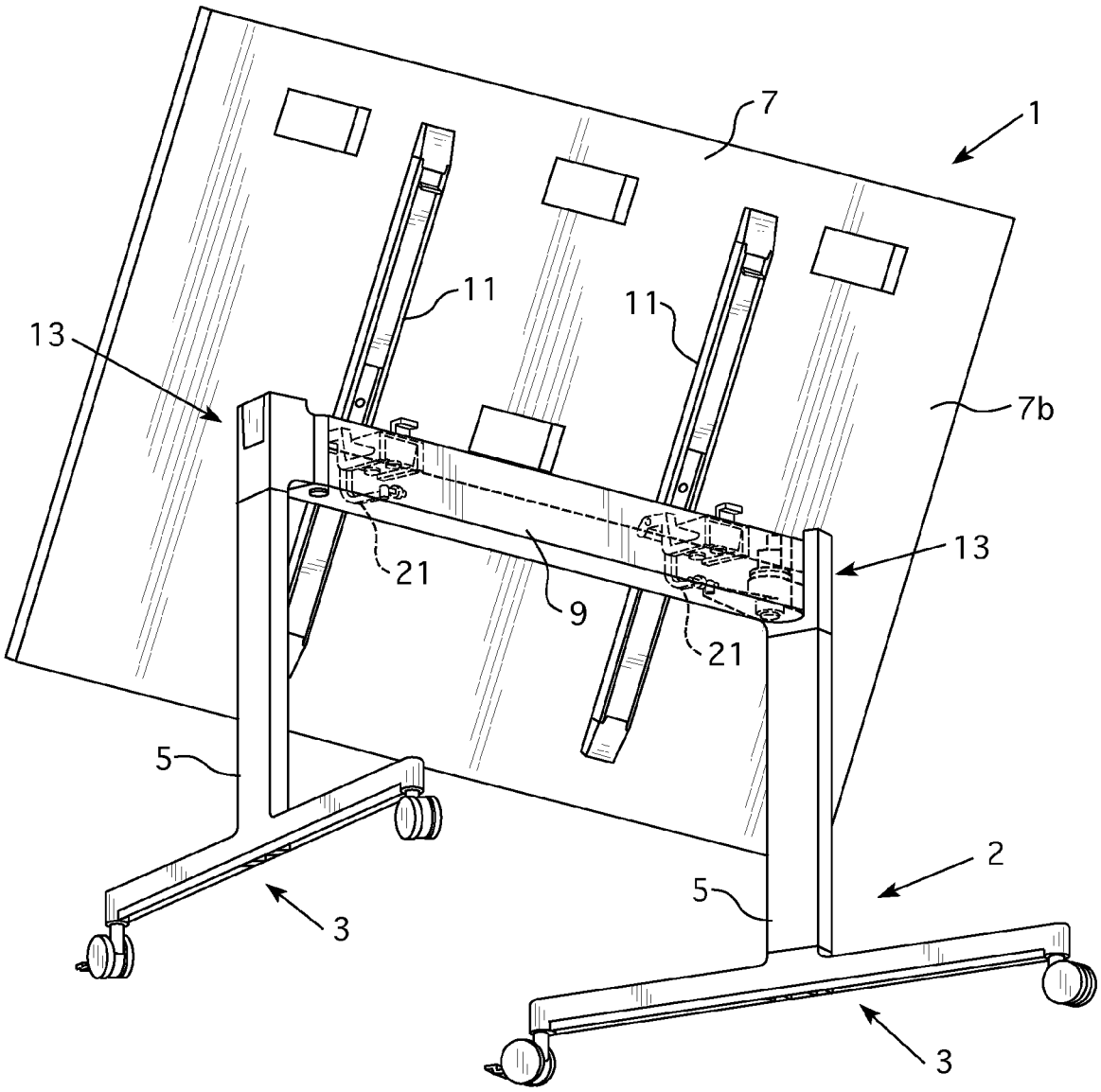
FIG. 7 is a rear perspective view of the first exemplary embodiment of the article of furniture in the second position.
Figure 8:
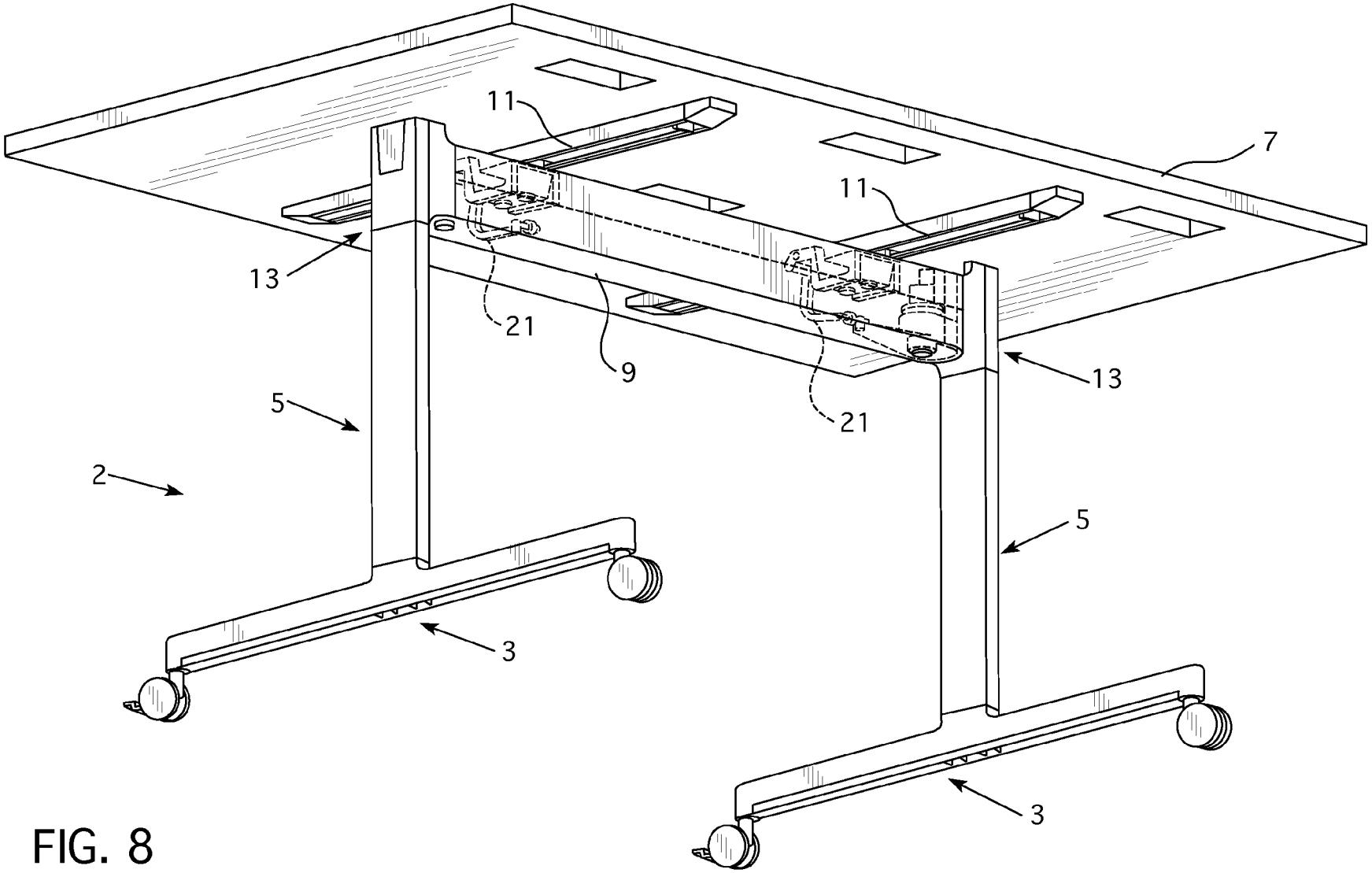
FIG. 8 is a bottom perspective view of the first exemplary embodiment of the article of furniture in the first position.
Figure 9:
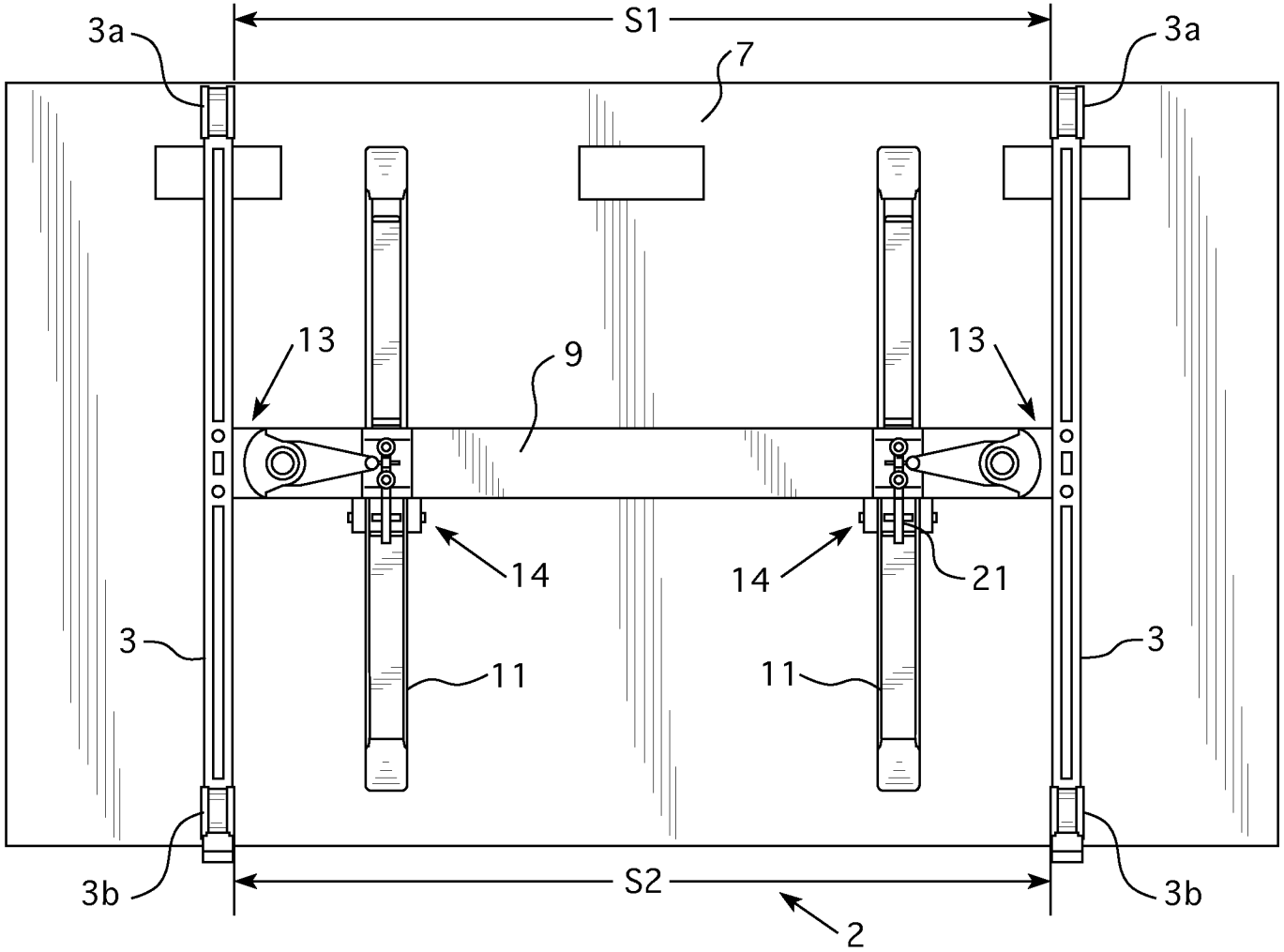
FIG. 9 is a bottom view of the first exemplary embodiment of the article of furniture in the first position.
Figure 10:
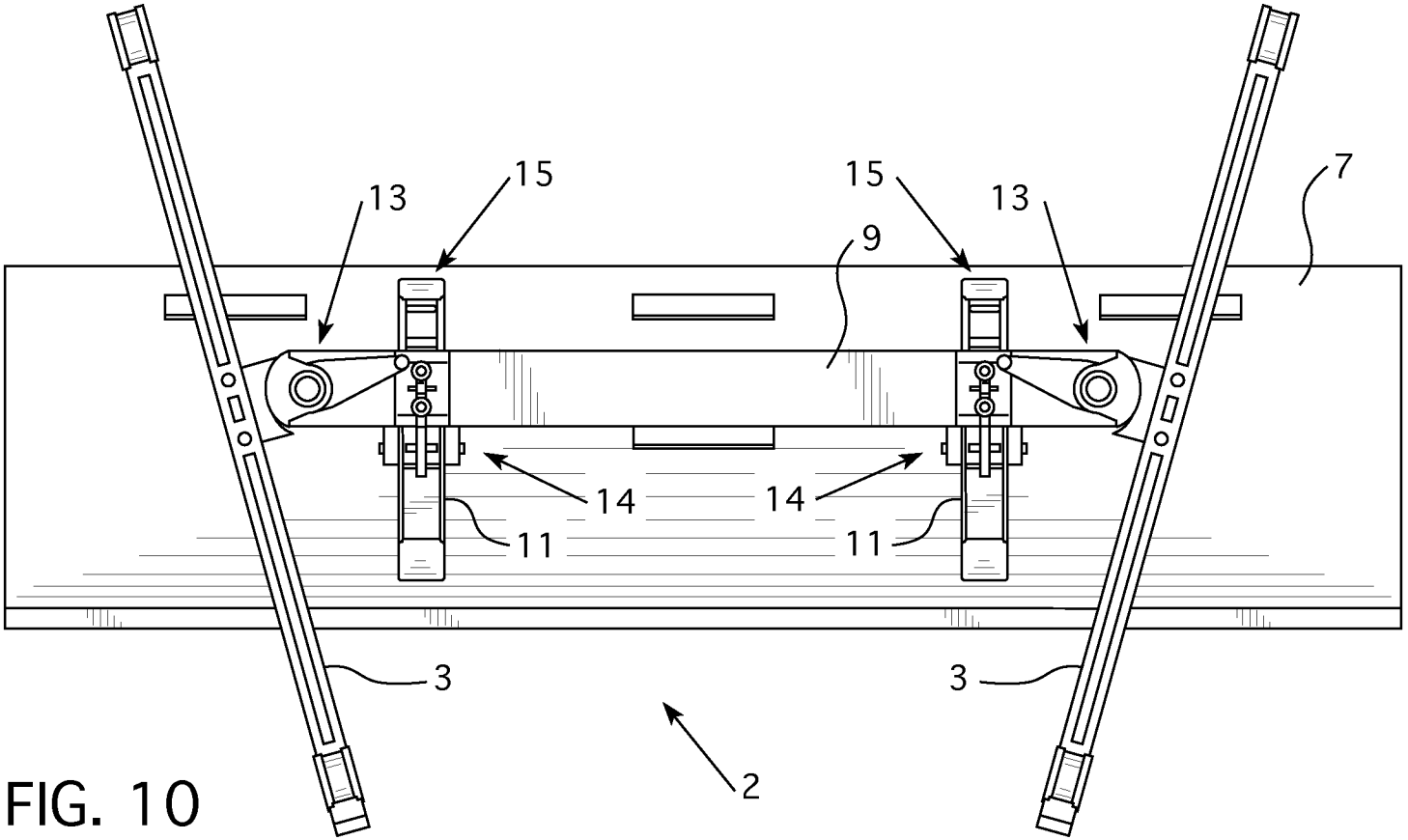
FIG. 10 is a bottom view of the first exemplary embodiment of the article of furniture in the second position.

An article of furniture 1 may be configured as a table. The table may include a base 2 that has feet 3 attached to respective legs 5. Each of the legs 5 may extend vertically from the one or more feet 3 to which the leg 5 is attached to adjacent a bottom surface of a tabletop 7. The legs 5 may be members that are composed of metal, a polymeric material, a composite material, wood, or a combination of such elements. Each leg 5 may be attached to a connecting structure, such as a feet supporting member or bracket that connects one or more feet 3 to that leg 5. The feet 3 may include front feet 3*a* and rear feet 3*b*. In some embodiments, the front feet 3*a* can be configured as first feet of first and second sides of the article of furniture that are adjacent a front side of the table and the rear feet 3*b* can be considered second feet of the first and second sides of the article that are adjacent a rear side of the table.

The feet 3 may include casters or floor contacting elements. For instance, the feet 3 may each be casters or wheels so that the articles are easily rollable along a floor or other surface for stowing the articles and subsequently moving the articles into a room and placing the articles into their first position for use in meetings or for use in a particular project or a particular work environment.

When the article of furniture is in a first position, the upper surface 7*a* of the tabletop 7 may be flat or substantially flat. For example, a first edge 7*c* of the tabletop may be at a same height as a second edge 7*d* of the tabletop 7. An opposite bottom surface 7*b* may also be flat or substantially flat. As another example, the upper and bottom surfaces 7*a* and 7*b* may be positioned to define a horizontal or substantially horizontal (e.g. a surface having a 1-5 degree angle of declination or inclination) surface when the article of furniture is in the first position. When the article of furniture is moved to a second position, the tabletop 7 may be tilted so that the upper surface extends from the first edge 7*c* to the second edge 7*d* substantially vertically (e.g. is at an angle of 45 degrees or greater relative to horizontal, at an angle of 70 degrees relative to horizontal, at an angle of between 85-90 degrees relative to horizontal, etc.) or is more steeply inclined or declined relative to the angle of inclination or declination of the upper surface 7*a* of the tabletop 7 when the tabletop 7 is in the first position. When the article of furniture 1 is in the second position, the second edge 7*d* may therefore be at a higher elevation than the first edge 7*c*.

It should be appreciated that the difference in elevation between the first and second edges 7*c* and 7*d* of the tabletop 7 may be substantially greater when the article of furniture 1 is in the second position as compared to when it is in the first position. For instance, when in the first position, the first and second edges 7*c* and 7*d* may be at the same height or about the same height so that a difference in their elevations is zero or about zero. In contrast, when the article of furniture is in the second position, the height of the second edge 7*d* may be substantially greater than the height of the first edge 7*c* (e.g. 20 or more centimeters, 30 or more centimeters, at least one meter, 2 or more meters, between 20 centimeters and 2 meters, etc.

When the article of furniture 1 is moved from the first position to the second position the tabletop 7 is moved from a first position to a second position as noted above, shown in the drawings, and discussed further below. At the same time, legs 5 and feet 3 of the base are also moved from a first position to a second position. In the first position of the legs 5 and feet 3, the feet may be a same distance apart from each other. For instance, forward feet 3*a* may be separated from each other by a space S1 and rear feet 3*b* may be separated from each other by a space S2 when the article is in the first position and the legs 5 and feet 3 are in the first position. The distance of space S1 may be equal to the distance of space S2 or about equal to each other (e.g. within 2.5 centimeters and 9 centimeters of each other). When the article is in the second position and the legs 5 and feet 3 are in the second position, the front feet 3*a* may be separated from each other by a space S3 that is greater than the distance of space S1 and the rear feet 3*b* may be separated from each other by a space S4 that is narrower than the distance of space S2 such that the front feet 3*a* are closer to each other when in the first position as compared to the second position and the rear feet 3*b* are closer to each other when in the second position as compared to the first position. It is also contemplated that alternative embodiments of the article of furniture 1 may be configured so that the legs 5 and feet 3 are moved from the first position into the second position so that the rear feet 3*b* are spaced so that they are closer together when in the second position as compared to the first position and that the front feet 3*a* are spaced farther apart when in the second position as compared to the first position.

The article of furniture 1 may be configured to utilize an adjustment mechanism for actuating movement of the tabletop 7, legs 5 and feet 3 between the first and second positions so that the tabletop, legs 5, and feet 3 may be moved from their first position to their second position and subsequently moved from their second position to their first position. The adjustment mechanism may include at least one leg rotating mechanism 13 for rotating or twisting of the legs 5 and feet 3, at least one tilting mechanism 14 for tilting of the tabletop 7, and at least one latch mechanism 15 for releaseably locking the tabletop 7 in the first position to prevent accidental movement of the tabletop 7, legs 5, and feet 3 from their first position to their second position.

The latch mechanism 15 may include a slidable handle or moveable handle member that is biased to a locked position by one or more spring elements such as coil springs or elastomeric spring bodies that engage the handle and bias the handle to the locked position. A user may press on the handle or otherwise act on the handle to move the handle to an unlocked position by causing the handle to move against the direction of biasing force applied by the one or more spring elements. When the handle is moved to the unlocked position, the tabletop 7 is unlatched from the base 2 of the table and is tiltable from the first position to the second position. For instance, movement of the handle may cause a projection, or lockable member to slide out of contact or locked engagement with a latching member 15*a* that may define an opening for receiving and releaseably locking with the projection or lockable member so that the tabletop 7 is tiltable.

The tilting mechanism 14 may include multiple connector members 11 that are attached to the bottom surface 7*b* of the tabletop 7 and are releaseably attachable to a cross member 9 of the base 2 of the article of furniture 1 via the latching mechanism 15. Each connector member 11 may be connected to a latch mechanism 15 so that multiple latch mechanisms must be moved to the unlocked position to release the connector members 11 from the cross member 9. Alternatively, only one connector member 11 may have a latch mechanism that locks and unlocks the connector member 11 from the cross member to permit tilting of the tabletop 7. The latch mechanism attached to the connector member 11 may be an element that releaseably connects the connector member 11 to the cross member 9. Each connector member 11 or only one connector member 11 may therefore be releaseably connected to the cross member 9 in embodiments of the article of furniture 1.

Each connector member 11 may be a rectangular structure, a beam, a bar, a rod, or other structure that extends under a portion of the bottom surface 7*b* of the tabletop or is attached to the bottom surface 7*b* of the tabletop. Each connector member 11 attached to a latch mechanism 15 may define a channel or opening for housing the slidable handle of the latch mechanism. The one or more biasing spring elements of the latch mechanism can also be housed within the connector member 11 and be moveable (e.g. slideable) within the connector member to move in response to a user providing a force to move the slideable handle that may include a member that is coupled to the at least one biasing spring elements (e.g. coil springs). An interlockable element that is connected to the moveable handle and is configured to be moved from a locked position and an unlocked position from latch member 15*a* may also be housed within the connector member 11 and may be moveable within the connector member 11 from a locked position in which it contacts or otherwise engages the latch member 15*a* and a second position in which it is away from the latch member 15*a* or out of engagement with the latch member 15*a* to permit rotation of the connector member 11 relative to the cross member 9 about a rotational axis. The latch member 15*a* may be an integral component of a carriage 10 that is attached to the cross member 9 or may be a latch member 15*a* that is attached to a carriage 10 attached to the cross member 9 via one or more fasteners such as screws, bolts, another type of fastening mechanism such as one or more welded joints, or a combination of such fastening mechanisms.

The tilting mechanisms 14 may be configured to permit the tabletop 7 to rotate about a horizontal axis so that the tabletop 7 is vertically tiltable and moveable relative to the cross member 9. Each tilting mechanism 14 may be attached between the connector member 11 and the cross member 9 to connect the connector member 11 to the cross member 9. Each connector member 11 may be attached to a respective tilting mechanism 14. Alternatively, one tilting mechanism 14 may be attached to all the connector members 11 to moveably connect the connector members 11 to the cross member 9.

Figure 11:
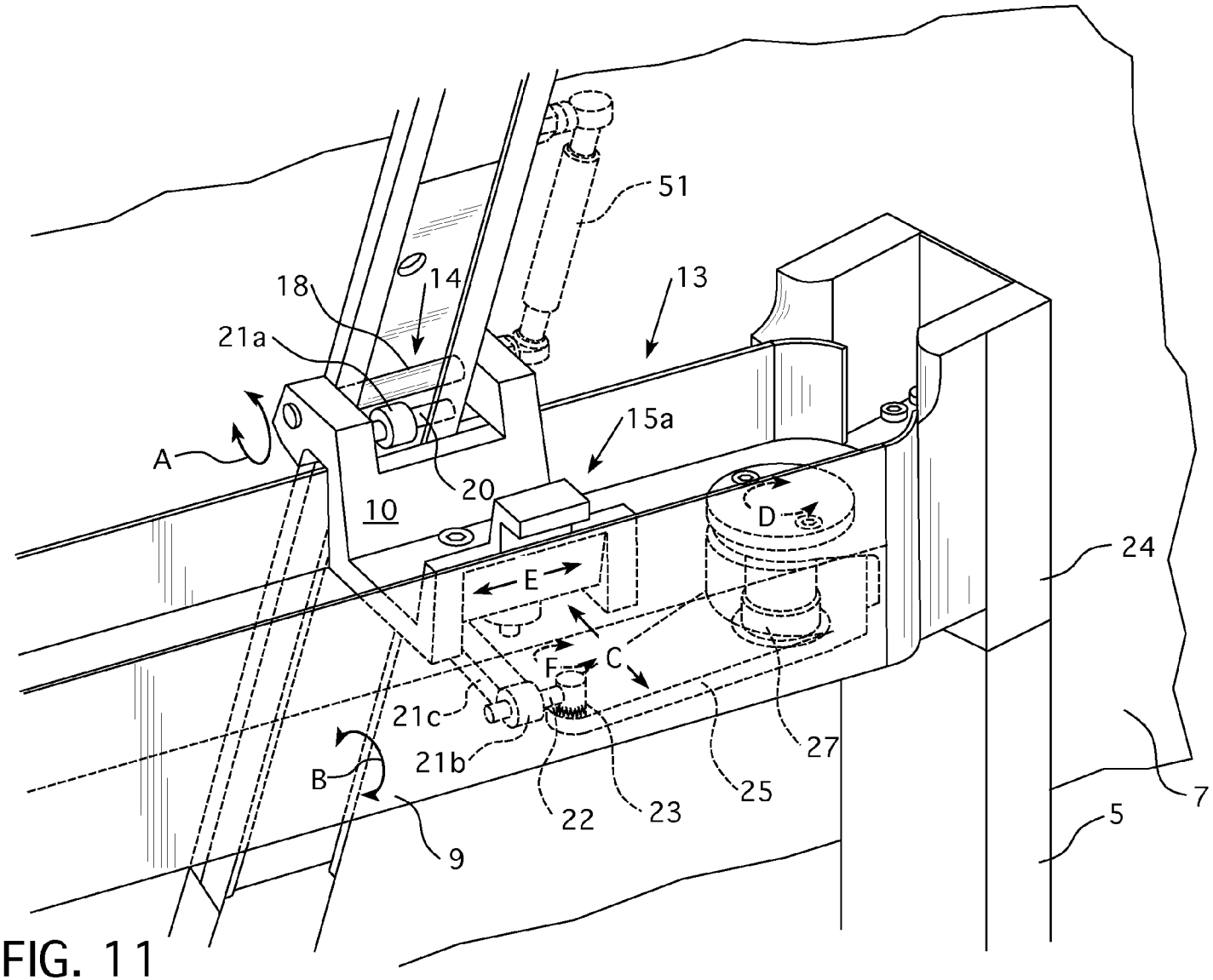
FIG. 11 is a fragmentary view of the first exemplary embodiment of the article of furniture that has portions of a leg rotating mechanism and cross member cut away to illustrate portions of the leg rotating mechanism, tabletop tilting mechanism, and latch mechanism of the first exemplary embodiment of the article of furniture while the article of furniture is in the second position.
Figure 12:
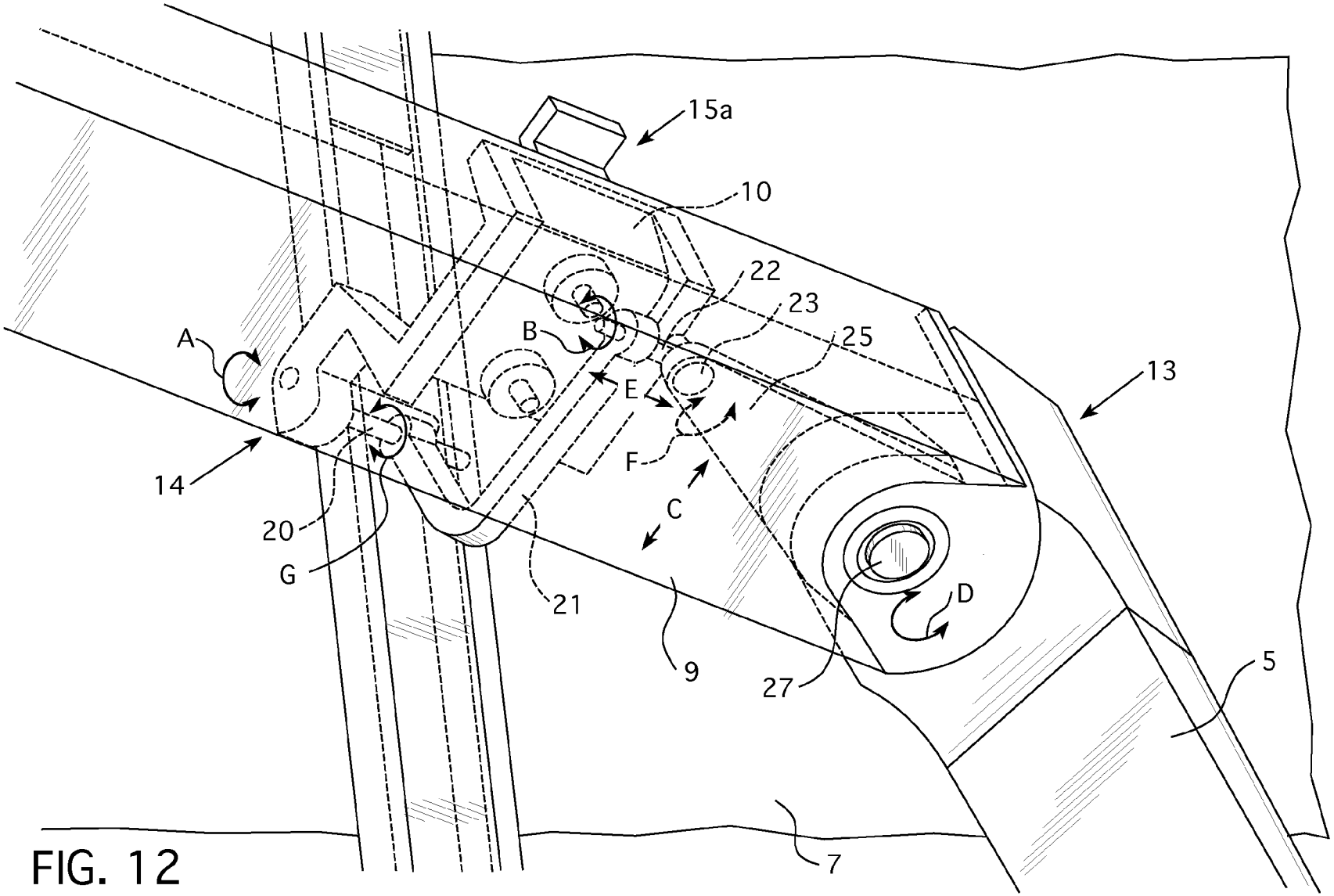
FIG. 12 is a bottom fragmentary view of the first exemplary embodiment of the article of furniture in the second position that has portions of the leg rotating mechanism, tabletop tilting mechanism, and latch mechanism of the first exemplary embodiment of the article of furniture shown in phantom view to illustrate components of these elements.

As may best be appreciated from FIGS. 11-12, each tilting mechanism 14 may include a shaft 18 that extends through holes in the connector member 11 and also extends through holes in a portion of the carriage 10 attached to the cross member 9. The shaft 18 may be a pin, rod, beam, member, or other element that defines a horizontal axle about which the connector member 11 can be rotatable when the latch mechanism 15 is moved to the unlocked position so that the connector member 11 is moveable about the shaft 18 in a first direction and an opposite second direction as indicated by arrow A. In some embodiments, the shaft 18 may rotate when the connector member 11 is rotated about the axle defined by the shaft. In some embodiments, a dampener 51 (e.g. a gas spring, a hydraulic spring, or other dampener element), which is shown in broken line in FIG. 11, can be attached between the carriage 10 and the connector member 11. The dampener 51 can be configured to help regulate the speed at which the table top 7 may rotate when the connector member 11 is rotated about the shaft 18. In some other embodiments, the dampener 51 may be attached between the carriage 10 and the table top 7, the cross member 9 and the table top 7, or the cross member 9 and the connector member 11, instead of (or in addition to) a dampener 51 being attached between the carriage 10 and the connector member 11.

Each leg rotating mechanism 13 may be attached between a respective leg 5 and a connector member 11 or tilting mechanism 14 so that rotation of the tabletop 7 from its first position to its second position also results in rotation of the legs 5 and feet 3 from their first position to their second position. For example, embodiments of the article of furniture 1 may include two legs 5 adjacent opposite sides of a tabletop 7 and include two leg rotating mechanisms 13, a first leg rotating mechanism attached to a first leg and a second leg rotating mechanism attached to the second leg opposite the first leg. In some embodiments, each leg rotating mechanism may be attached to a respective connector member 11 for attachment to a respective component of a tilting mechanism 14. In other embodiments, multiple leg rotating mechanisms 13 may be attached to opposite ends of the same cross member 9 for attachment to the same component of a tilting mechanism 14.

Each leg rotating mechanism 13 may include a first rod 20 that is positioned within a connector member 11 or is attached to the connector member 11. The first rod 20 may be a rod, pin, or other type of linearly extending elongated member (e.g. a shaft). A first end 21*a* of a curved L-shaped member 21 may be attached to the first rod 20 and may be rotatably attached so that it can rotate about the first rod 20 or may be immovably affixed to the first rod 20. When rotatably attached to the first rod 20, the first end 21*a* of the L-shaped member 21 may be rotatable about the first rod 20 in two opposite directions as indicated by arrow G. The L-shaped member is considered to be L-shaped because it is generally L-shaped as it has a curved "L" type shape. The L-shaped member could alternatively be configured as a generally V-shaped member, a generally U-shaped member, a generally C-shaped member, or other curved member or polygonal member. The L-shaped member 21 may be immovably affixed or rotatably attached to the first rod 20, which may be attached to and positioned within the connector member 11. The L-shaped member 21 extends from its first end 21*a* to its second end 21*b*. An intermediate portion 21*c* of the L-shaped member 21 that is between the first and second ends 21*a* and 21*b* passes through an opening in the cross member 9. The second end 21*b* of the L-shaped member 21 is positioned within the cross member 9 and is attached to a second rod 22. The second rod 22 may be a rod, pin, or other type of linearly extending elongated element (e.g. a shaft) that extends from the second end 21*b* of the L-shaped member to a pin 23. The second rod may be rotatably attached to the second end 21*b* of the L-shaped member 21 so that the second end 21*b* is rotatable about the second rod 22. For example, the second end 21*b* may be rotatable about the second rod 22 in two different opposite directions as indicated by arrow B in FIG. 11. The second rod 22 may therefore function as an axle along which the second end 21*b* of the L-shaped member 21 is rotatable.

A first end portion of the second rod 22 may be positioned within an opening formed in the second end 21*b* of the L-shaped member 21. The second rod 22 may be positioned through the opening of the second end 21*b* of the L-shaped member through which the second rod 22 extends. The second rod 22 may be slideable through this opening of the second end 21*b* of the L-shaped member 21. It is contemplated that the terminal end of the first end portion of the second rod 22 may have a head or oversized dimension that is able to prevent the first end from sliding out of the opening of the second end 21*b* of the L-shaped member. The second rod may be slideable in two opposite directions as indicated by arrow E in FIGS. 11-12. A second end portion of the second rod 22 that is opposite the second rod's first end portion may extend through an opening formed in a pin 23. The second end portion of the second rod 22 may be immovably affixed to the pin 23 in some embodiments of the article of furniture.

The pin 23 is attached to a rotatable arm 25 that extends from the leg 5. For example, the arm 25 can extend from a leg connecting body 24 that is attached to the leg 5 between the leg 5 and the arm 25. Alternatively, the arm 25 can extend directly from the leg 5 and may have an end that is directly attached to the leg 5. The pin 23 may be rotationally attached to a distal end of the arm 25 so that the pin is rotatable in two opposite directions as indicated by arrow F while being attached to the arm 25. The arm 25 can be rotationally attached to a bottom portion of the pin 23 and the upper portion of the pin 23 defines the opening for receiving the second end of the second pin 22. The arm 25 is attached to the pin 23 so that forward and rearward movement of the second end 21*b* of the L-shaped member 21 as indicated by arrow C in FIG. 1 also causes the distal end of arm 25 to move forwardly and rearwardly and drives rotational movement of the arm about a cylindrical element 27 attached to the cross member 9 as indicated by arrow D. During the rotational movement of the arm 25, the pin 23 may rotate as indicated by arrow F and a portion of the second rod 22 may slide through the opening of the second end 21*b* of the L-shaped member as indicated by arrow E.

The arm 25 is positioned within the cross member 9 so that the arm 25 is moveable within the cross member 9. The arm 25 has a passageway defined therein through which a generally cylindrical element 27 passes. The cylindrical element 27 may define a vertical axle about which the arm 25 is rotatable in two opposite directions as indicated by arrow D in FIG. 11. A proximal end of the arm 25 is attached to a leg connecting body 24 that is attached to an upper portion of the leg 5 so that the leg connecting body 24 and leg 5 to which it is attached rotate in the same direction that the arm 25 is rotated when the arm 25 is rotated about the axle defined by the cylindrical element 27.

The arm 25 may be integrally connected to the leg 5 via welding or by being a cast structure that defines both the arm 25 and leg connecting body 24. Alternatively, the arm 25 may be fastened to the leg connecting body 24 via one or more fasteners or fastening mechanisms such as bolts and screws, or a combination of welding and fasteners. The leg connecting body 24 may be attached to the upper end of the leg 5 via one or more fasteners. Alternatively, the leg connecting body 24 may be integral with the upper end of the leg 5 by being formed on the upper end of the leg when the leg is molded or cast or being welded or bonded onto the upper end of the leg 5.

It should be appreciated that each leg 5 may be attached to a respective leg rotating mechanism 13. Each respective leg rotating mechanism 13 may be attached to a respective connector member 11 and be attached to or positioned in a respective end or side of the cross member 9. Alternatively each leg rotating mechanism 13 may be attached to the same connector member 11.

The cross member 9 may be a polygonal shaped bar or beam, or may be sized and configured as a rod or other structure. The cross member 9 may extend between two opposing legs 5 below the bottom surface 7*b* of the tabletop 7 when the tabletop 7 is in the first position. An upper channel may be defined within the cross member for receiving one or more carriages 10 and also for providing a conduit for wire management (e.g. power cables for electronic devices, Ethernet cabling, other cabling, etc.) Each end of the cross member may be configured to retain or receive a respective carriage 10 for attachment of the cross member 9 to a respective connector member 11. Each carriage 10 may be configured to interlock with a top profile defined on the upper portion of the cross member. In addition, or as an alternative, the carriage may be fastened to the cross member by one or more fasteners or fastening mechanisms such as bolts, screws, welding, or a combination of such fastening mechanisms. Each end of the cross member may also have a lower space, lower area, lower compartment, or a portion of a lower channel that is below the upper channel that has an open volume that is sized and shaped to receive a portion of the cylindrical element 27, the second end 21*b* of the L-shaped member 21, the second rod 22, the pin 23, and the arm 25.

Figure 13:
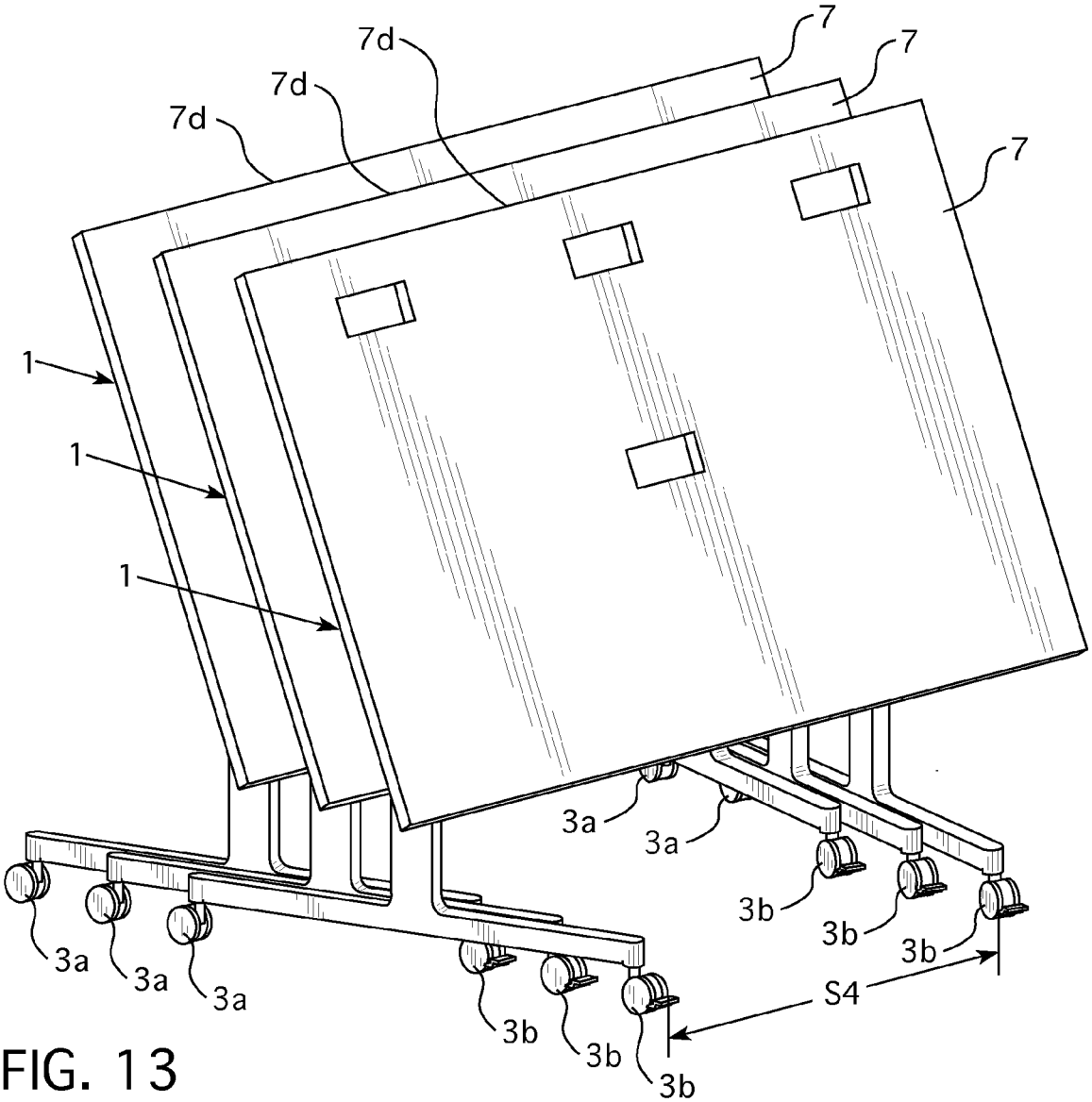
FIG. 13 is a perspective view of a stacked set of the first exemplary embodiments of the article of furniture in their second positions being nested together for stowing of the articles of furniture.

Embodiments of the article of furniture are configured so that lifting of the tabletop 7 from its first position to its second position automatically also adjusts the legs 5 and feet 3 to their second position so that the article is configured for stowing the table in a nested arrangement with multiple other articles all positioned in the same arrangement as shown, for example, in FIG. 13. Such a configuration can permit the articles of furniture to all be placed into the second position and stowed or otherwise stacked in a nested, compact arrangement so that floor space may be economically used for storing of the articles. When needed for a project or work function, the articles may then be removed from their stacked, nested arrangement, moved to a desired position, and adjusted from the second position to their first position. It should be appreciated that the stacking of the tables for such embodiments can be a horizontal stacking of the nested tables.

For instance, lifting of the tabletop from its first position to its second position may cause the cross members 11 to rotate about shafts 18 and also cause the first ends 21*a* of the L-shaped members connected to first rods 20 to rotate or otherwise move so that the second ends 21*b* of the L-shaped members 21 move forwardly within the cross member 9, which drives forward movement of the distal ends of the arms 25 so that the arms 25 rotate about the cylindrical elements 27 and cause rotation, or twisting, of the leg connecting bodies 24 and legs 5 to which those bodies are attached. Each arm 25 is driven by the forward motion of the L-shaped member 21 to which it is connected via the second rods 22 and pins 23 connecting that arm 25 to the L-shaped member 21. During forward movement of the L-shaped members, the second rods 22 attached to the L-shaped members 21 slide through the opening in the second ends 21*b* of the L-shaped members toward the arms 25 and the pins 23 rotates as the L-shaped members are moved forwardly and the second rods 22 slide. The rotation of the pins 23 and sliding and forward movement of the second rods 22 and forward movement of the L-shaped members 21 cooperate to drive rotation of the arms 25. Each of the pins 23 of the leg rotating mechanisms 13 may rotate counterclockwise when the L-shaped member to which they are connected is moved forwardly and each of the second rods 22 may be slid toward the pin 23 to which that second rod 22 is attached. In other embodiments, the pin 23 may be configured to rotate in a clockwise direction when the L-shaped member to which it is attached is moved forwardly.

Rotation or twisting of the legs 5 caused via tilting of the tabletop 7 from its first position to its second position causes the feet 3 to move so that the front feet 3*a* move away from each other and the rear feat 3*b* move closer to each other. When the tabletop 7 is tilted from its second position to its first position, the cross members 11 rotate about shafts 18 and cause the first ends 21*a* of the L-shaped members 21 to rotate or otherwise move so that the second ends 21*b* of the L-shaped members move rearwardly. Rearward movement of the second ends 21*b* of the L-shaped members causes the distal ends of the arms 25 to move rearwardly and rotation of the arms 25 and leg connecting bodies 24 to occur so that the legs 5 are rotated toward their first position and feet 3 are rotated to their first position. The second rods 22 also slide through the openings of the second ends 21*b* of the L-shaped members in a direction that is away from the respective pins 23 to which the second rods 22 are attached during rearward movement of the L-shaped member. The pins 23 also rotate and moves rearwardly during rearward motion of the second ends 21*b* of the L-shaped members 21 so that the arms 25 to which the pins 23 are attached are rotated about the axles defined by the cylindrical elements 27 during the rearward movement of the L-shaped members 21 in a direction that is opposite the direction the arms are rotated when the second ends 21*b* of the L-shaped members 21 were moved forwardly. When moving from the second position of the front feet 3*a* to the first position of the front feet 3*a*, the front feet 3*a* are moved closer to each other. When moving from the second position of the rear feet 3*b* to the first position of the rear feet 3*b*, the rear feet 3*b* are moved farther away from each other.

Multiple embodiments of the article of furniture may be provided. For instance, multiple tables embodying the article of furniture may be provided. The tabletops 7 of each table may be moved to the second position so that the feet and legs of the table are moved to their second positions. Thereafter, the tables may be placed in a line and nested together so that immediately adjacent tables are nested with other tables in a line of tables. For instance, a first table may be nested with a second table so that the rear feet 3*b* of the first table extend under the tabletop of the second table between the legs of the second table. A third table moved to the second position may then be nested with the first table that is in the second position so that the rear feet 3*b* of the third table extend below the tabletop of the first table between the legs of the first table.

It should be appreciated that variations to the article of furniture may be made to form embodiments of our article of furniture. For instance, a tilt mechanism 14 may be connected to multiple connector members 11, but a latch mechanism 15 may only be connected to one connector member 11 to lock and unlock the tabletop 7 for tilting of the tabletop 7. As another example, the leg rotating mechanisms 13 may each be connected to a respective housing instead of a cross member 9. Each housing may be positioned adjacent a respective leg and a respective connector member 11 for connecting the leg rotating mechanism between a respective leg 5 and the tabletop 7. As such, the housings could replace the carriages 10 and cross member 9. As yet another example, the L-shaped members 21 could be replaced with a member having a different shape or interconnected linkages that are pivotally connected together or may be replaced with a cabling arrangement.

As yet another example, embodiments of the article may be chairs and may be configured for use in connection with legs of a chair to facilitate the stowing of chairs or storage of chairs. Such an arrangement may be useful for side seating arrangements, for example. For such embodiments, the tabletops 7 would be a different structure, such as seats of a chair and the legs 5 may be legs of a chair. The tilting mechanism 14, latch mechanism 15 and leg rotating mechanism 13 may each be attached between the seat of the chair and legs of the chair. One or more connector members 11 may be connected to a bottom surface of the seat when the chair is in a sitting position for connecting the tilting mechanism 14, latch mechanism 15, and leg rotating mechanism 13 between the seat and the legs of the chair.

As yet another example, each leg 5 may be a member that connects multiple legs of a chair or table legs to a leg rotating mechanism for rotating those table legs or chair legs. As yet another example, the cross member 9 may be formed from a unitary beam or from multiple beam elements that are fastened together to form the cross member. As yet another example, articles of furniture may have multiple sets of legs and multiple cross members so that a respective cross member is connected between a respective set of legs.

Therefore it should be understood that while certain exemplary embodiments of articles of furniture and methods of making and using the same have been discussed and illustrated herein, it is to be distinctly understood that the invention is not limited thereto but may be otherwise variously embodied and practiced within the scope of the following claims.

What is claimed is:

1. An article of furniture comprising:

a first structure having a first surface and a second surface opposite the first surface, the first and second surfaces extending from a first edge of the first structure to a second edge of the first structure that is opposite the first edge of the first structure;

a first tilting mechanism attached to the first structure, the first tilting mechanism sized and configured such that the first structure is rotatable from a first position to a second position, the first edge of the first structure being at a first elevation when the first structure is in the first position and the first edge of the first structure being at a second elevation that is higher than the first elevation when the first structure is in the second position;

a first leg, the first leg being movable from a first position to a second position;

a first leg rotating mechanism attached between the first leg and the first tilting mechanism, the first leg rotating mechanism rotating the first leg from the first position of the first leg to the second position of the first leg when the first structure is rotated from the first position of the first structure to the second position of the first structure;

wherein the article of furniture is a table or a chair and the first structure is a tabletop or a seat;

a second leg, the second leg being movable from a first position to a second position;

a second tilting mechanism attached to the first structure, the second tilting mechanism sized and configured such that the first structure is rotatable from the first position to the second position, a second leg rotating mechanism attached between the second leg and the second tilting mechanism, the second leg rotating mechanism rotating the second leg from the first position of the second leg to the second position of the second leg when the first structure is rotated from the first position of the first structure to the second position of the first structure;

at least one first foot connected to the first leg;

at least one second foot connected to the second leg;

the first tilting mechanism comprising a first carriage connected to the first structure such that the first structure is rotatable about a horizontal axis from the first position of the first structure to the second position of the first structure;

the first leg rotating mechanism comprising a first member, a first arm, and a first leg connecting body connecting the first leg rotating mechanism to the first leg, the first member having a first end connected to a portion of the first tilting mechanism and a second end connected to the first arm, the first end of the first member connected to the first tilting mechanism such that the first member moves when the first structure is moved from the first position of the first structure to the second position of the first structure, the movement of the first member causing the first arm to move to drive rotation of the first leg connecting body so that the first leg is rotated and the at least one first foot is rotated from a first position to a second position;

the second tilting mechanism comprising a second carriage connected to the first structure such that the first structure is rotatable about the horizontal axis from the first position of the first structure to the second position of the first structure; and the second leg rotating mechanism comprising a second member, a second arm, and a second leg connecting body connecting the second leg rotating mechanism to the second leg, the second member having a first end connected to a portion of the second tilting mechanism and a second end connected to the second arm, the first end of the second member connected to the second tilting mechanism such that the second member moves when the first structure is moved from the first position of the first structure to the second position of the first structure, the movement of the second member causing the second arm to move to drive rotation of the second leg connecting body so that the second leg is rotated and the at least one second foot is rotated from a first position to a second position;

wherein the first tilting mechanism is comprised of a first connector member and a first shaft connected to the first connector member, the first shaft also connected to the first carriage such that the first connector member is rotatable about the first shaft;

wherein the second tilting mechanism is comprised of a second connector member and a second shaft connected to the second connector member, the second shaft also connected to the second carriage such that the second connector member is rotatable about the second shaft;

the first connector member attached to the first surface of the first structure and the second connector member attached to the first surface of the first structure;

wherein the first and second connector members connect the first structure to the first and second tilting mechanisms to permit the first structure to be rotated from the first position of the first structure to the second position of the first structure, the first and second shafts defining an axis about which the first structure is rotatable.

2. The article of furniture of claim 1 wherein the first member of the first leg rotating mechanism extends from adjacent the first connector member to adjacent the first arm and wherein the second member of the second leg rotating mechanism extends from adjacent the second connector member to adjacent the second arm.

3. The article of furniture of claim 1 further comprising a cross member extending between the first leg and the second leg, the first arm being positioned within a first end of the cross member and the second arm being positioned within a second end of the cross member that is opposite the first end of the cross member, the first carriage attached to the cross member such that the first arm is below the first carriage and the second carriage attached to the cross member such that the second arm is below the second carriage.

4. The article of furniture of claim 3 wherein the first leg rotating mechanism is also comprised of a first pin attached to a distal end of the first arm, and a first element extending from the first pin to the second end of the first member; and the second leg rotating mechanism is also comprised of a second pin attached to a distal end of the second arm and a second element extending from the second pin to the second end of the second member.

5. The article of furniture of claim 4 wherein the first pin is rotatably connected to the distal end of the first arm and wherein the second pin is rotatably connected to the distal end of the second arm.

6. The article of furniture of claim 5 wherein the first element is slideably connected to the second end of the first member and wherein the second element is slideably connected to the second end of the second member.

7. The article of furniture of claim 6 wherein the first leg rotating mechanism is also comprised of a first axle extending through a portion of the first arm, the first arm being rotatable about the first axle such that movement of the distal end of the first arm causes rotation of the first arm about the first axle and drives rotation of the first leg connecting body; and the second leg rotating mechanism is also comprised of a second axle extending through a portion of the second arm, the second arm being rotatable about the second axle such that the movement of the distal end of the second arm causes rotation of the second arm about the second axle and drives rotation of the second leg connecting body.

8. The article of furniture of claim 7 wherein the at least one first foot is comprised of a first front foot and a first rear foot and the at least one second foot is comprised of a second rear foot and a second front foot; and when the first front foot is in the second position of the first front foot and the second front foot is in the second position of the second front foot, the first and second front feet are farther apart as compared to when the first front foot is in the first position of the first front foot and the second front foot is in the first position of the second front foot; and when the first rear foot is in the second position of the first rear foot and the second rear foot is in the second position of the second rear foot, the first and second rear feet are closer together as compared to when the first rear foot is in the first position of the first rear foot and the second rear foot is in the first position of the second rear foot.

9. The article of furniture of claim 8 wherein the first front foot is a caster, the second front foot is a caster, the third front foot is a caster and the fourth front foot is a caster.

10. The article of furniture of claim 1 wherein the first member of the first leg rotating mechanism is a generally L-shaped member, a generally C-shaped member, a generally U-shaped member or a generally V-shaped member.

11. The article of furniture of claim 10 wherein the second member of the second leg rotating mechanism is a generally L-shaped member, a generally C-shaped member, a generally U-shaped member or a generally V-shaped member.

12. An article of furniture comprising:

a first structure having a first surface and a second surface opposite the first surface, the first and second surfaces extending from a first edge of the first structure to a second edge of the first structure that is opposite the first edge of the first structure;

a first tilting mechanism attached to the first structure, the first tilting mechanism sized and configured such that the first structure is rotatable from a first position to a second position, the first edge of the first structure being at a first elevation when the first structure is in the first position and the first edge of the first structure being at a second elevation that is higher than the first elevation when the first structure is in the second position;

a first leg, the first leg being movable from a first position to a second position;

a first leg rotating mechanism attached between the first leg and the first tilting mechanism, the first leg rotating mechanism rotating the first leg from the first position of the first leg to the second position of the first leg when the first structure is rotated from the first position of the first structure to the second position of the first structure;

wherein the article of furniture is a table or a chair and the first structure is a tabletop or a seat;

a second leg, the second leg being movable from a first position to a second position;

a second tilting mechanism attached to the first structure, the second tilting mechanism sized and configured such that the first structure is rotatable from the first position to the second position, a second leg rotating mechanism attached between the second leg and the second tilting mechanism, the second leg rotating mechanism rotating the second leg from the first position of the second leg to the second position of the second leg when the first structure is rotated from the first position of the first structure to the second position of the first structure;

at least one first foot connected to the first leg;

at least one second foot connected to the second leg;

the first tilting mechanism comprising a first carriage connected to the first structure such that the first structure is rotatable about a horizontal axis from the first position of the first structure to the second position of the first structure; and the first leg rotating mechanism comprising a first member, a first arm, and a first leg connecting body connecting the first leg rotating mechanism to the first leg, the first member having a first end connected to a portion of the first tilting mechanism and a second end connected to the first arm, the first end of the first member connected to the first tilting mechanism such that the first member moves when the first structure is moved from the first position of the first structure to the second position of the first structure, the movement of the first member causing the first arm to move to drive rotation of the first leg connecting body so that the first leg is rotated and the at least one first foot is rotated from a first position to a second position;

wherein the at least one first foot is comprised of a plurality of casters and the at least one second foot is comprised of a plurality of casters.

13. The article of furniture of claim 12 wherein:

the second tilting mechanism comprising a second carriage connected to the first structure such that the first structure is rotatable about the horizontal axis from the first position of the first structure to the second position of the first structure; and the second leg rotating mechanism comprising a second member, a second arm, and a second leg connecting body connecting the second leg rotating mechanism to the second leg, the second member having a first end connected to a portion of the second tilting mechanism and a second end connected to the second arm, the first end of the second member connected to the second tilting mechanism such that the second member moves when the first structure is moved from the first position of the first structure to the second position of the first structure, the movement of the second member causing the second arm to move to drive rotation of the second leg connecting body so that the second leg is rotated and the at least one second foot is rotated from a first position to a second position.

14. An article of furniture comprising:

a tabletop of a first structure, the tabletop having a first surface and a second surface opposite the first surface, the first and second surfaces extending from a first edge of the tabletop to a second edge of the tabletop that is opposite the first edge of the tabletop;

a first tilting mechanism attached to the tabletop, the first tilting mechanism being sized and configured such that the first tabletop is rotatable from a first position to a second position such that the first structure is moveable from a first position to a second position, the first edge of the tabletop being at a first elevation when the tabletop is in the first position and the second edge of the tabletop being at a second elevation when the tabletop is in the second position, the second elevation being higher than the first elevation;

a first leg attached to the first tilting mechanism via a first leg rotating mechanism attached between the first leg and the first titling mechanism, the first leg rotating mechanism being attached between the first leg and the first tilting mechanism such that the first leg is moveable from a first position to a second position when the tabletop is moved from the first position of the tabletop to the second position of the tabletop;

a second leg, the second leg being movable from a first position to a second position;

a second tilting mechanism attached to the tabletop, the second tilting mechanism sized and configured such that the tabletop is rotatable from the first position of the tabletop to the second position of the tabletop, a second leg rotating mechanism attached between the second leg and the second tilting mechanism, the second leg rotating mechanism being configured to rotate the second leg from the first position of the second leg to the second position of the second leg when the tabletop is rotated from the first position of the first structure to the second position of the first structure;

the first tilting mechanism comprising:

a first carriage positioned between the first leg and the tabletop, a first connector member attached to the first surface of the tabletop and rotatably connected to the first carriage, a first shaft attached to the first connector member, and the second tilting mechanism comprising:

a second carriage positioned between the second leg and the tabletop, a second connector member attached to the first surface of the tabletop and rotatably connected to the second carriage, and a second shaft attached to the second connector member;

the first leg rotating mechanism comprising:

a first member having a first end connected to the first shaft and a second end opposite the first end of the first member, a first arm, a first pin rotatably attached to a distal end of the first arm, a first element extending from the first pin to within the second end of the first member, the first element being moveably positionable within the second end of the first member, a first leg connecting body connecting the first arm to the first leg, a first axle extending through a portion of the first arm, the first arm being rotatable about the first axle such that movement of the distal end of the first arm causes rotation of the first arm about the first axle and causes movement of the first leg connecting body to rotate the first leg from the first position of the first leg to the second position of the first leg;

the second leg rotating mechanism comprising:

a second member having a first end connected to the second shaft and a second end opposite the first end of the second member, a second arm, a second pin rotatably attached to a distal end of the second arm, a second element extending from the second pin to within the second end of the second member, the second element being moveably positionable within the second end of the second member, a second leg connecting body connecting the second arm to the second leg, a second axle extending through a portion of the second arm, the second arm being rotatable about the second axle such that movement of the distal end of the second arm causes rotation of the second arm about the second axle and causes rotation of the second leg connecting body to rotate the second leg from the first position of the second leg to the second position of the second leg;

the first and second shafts defining an axis about which the tabletop is rotatable when the tabletop moves from the first position to the second position;

the first end of the first member of the first leg rotation mechanism rotating during movement of the tabletop from the first position of the tabletop to the second position of the tabletop, rotation of the first end of the first member causing the first element to move within the second end of the first member and causing the first pin to rotate relating to the distal end of the first arm and also causing the first pin to move to drive rotation of the first arm about the first axle such that the first leg connecting body moves to rotate the first leg from the first position of the first leg to the second position of the first leg; and the first end of the second member of the second leg rotation mechanism rotating during movement of the tabletop from the first position of the tabletop to the second position of the tabletop, rotation of the first end of the second member causing the second element to move within the second end of the second member and causing the second pin to rotate relating to the distal end of the second arm and also causing the second pin to move to drive rotation of the second arm about the second axle such that the second leg connecting body moves to rotate the second leg from the first position of the second leg to the second position of the second leg.

15. The article of furniture of claim 14 further comprising a cross member extending between the first leg and the second leg, the first arm being positioned within a first end of the cross member and the second arm being positioned within a second end of the cross member that is opposite the first end of the cross member, the first carriage attached to the cross member such that the first arm is below the first carriage and the second carriage attached to the cross member such that the second arm is below the second carriage.

16. The article of furniture of claim 15, wherein the first member of the first leg rotating mechanism also has an intermediate member extending between the first and second ends of the first member of the first leg rotating mechanism such that the first member is a generally L-shaped member, a generally C-shaped member, a generally U-shaped member or a generally V-shaped member; and wherein the second member of the second leg rotating mechanism also has an intermediate member extending between the first and second ends of the second member of the second leg rotating mechanism such that the second member is a is a generally L-shaped member, a generally C-shaped member, a generally U-shaped member or a generally V-shaped member.

17. The article of furniture of claim 16, wherein the first element is a rod, a linearly extending member, a pin or a shaft and the second element is a rod, a linearly extending member, a pin or a shaft.

18. The article of furniture of claim 16, wherein the first shaft is a linearly extending member and the second shaft is a linearly extending member.

19. The article of furniture of claim 14, comprising a first front foot and a first rear foot connected to the first leg and a second front foot and a second rear foot connected to the second leg.

20. The article of furniture of claim 19, wherein the first front foot and the second front foot are moved away from each other when the first and second legs are moved from their first positions to their second positions.

21. The article of furniture of claim 20, wherein the first rear foot and the second rear foot are moved to be closer to each other when the first and second legs are moved from their first positions to their second positions.

22. The article of furniture of claim 19, wherein the first front foot is comprised of a caster, the first rear foot is comprised of a caster, the second front foot is comprised of a caster, and the second rear foot is comprised of a caster.

* * * * *